US007503958B2

(12) United States Patent
Matsubara et al.

(10) Patent No.: US 7,503,958 B2
(45) Date of Patent: Mar. 17, 2009

(54) METHOD OF MANUFACTURING THE SNZNNICU SOLDER POWDER AND THE SNZNNICU SOLDER POWDER

(75) Inventors: Eiichiro Matsubara, Kyoto (JP); Tetsu Ichitsubo, Kyoto (JP); Takaaki Anada, Kakogawa (JP); Seishi Kumamoto, Kakogawa (JP); Hisao Irie, Kakogawa (JP)

(73) Assignee: Harima Chemicals, Inc., Hyogo (JP)

( * ) Notice: Subject to any disclaimer, the term of this patent is extended or adjusted under 35 U.S.C. 154(b) by 201 days.

(21) Appl. No.: 11/509,567

(22) Filed: Aug. 25, 2006

(65) Prior Publication Data

US 2007/0051201 A1 Mar. 8, 2007

(30) Foreign Application Priority Data

Aug. 25, 2005 (JP) ..... 2005-244442

(51) Int. Cl.
*B22F 9/08* (2006.01)

(52) U.S. Cl. ..... 75/338; 75/355

(58) Field of Classification Search ..... None
See application file for complete search history.

(56) References Cited

U.S. PATENT DOCUMENTS

| | | | | |
|---|---|---|---|---|
| 3,646,177 | A | 2/1972 | Thompson et al. | |
| 4,376,740 | A | 3/1983 | Uda et al. | |
| 4,793,853 | A * | 12/1988 | Kale | 75/338 |
| 4,897,111 | A | 1/1990 | Jonsson et al. | |
| 5,094,813 | A * | 3/1992 | Kale | 420/560 |
| 5,294,242 | A | 3/1994 | Zurecki et al. | |
| 6,444,009 | B1 * | 9/2002 | Liu et al. | 75/332 |
| 7,070,736 | B2 * | 7/2006 | Yoshikawa et al. | 420/557 |

FOREIGN PATENT DOCUMENTS

| | | |
|---|---|---|
| EP | 2005238297 | 9/2005 |
| JP | 8-243782 A | 9/1996 |
| JP | 9-094687 A | 4/1997 |
| JP | 9-094688 A | 4/1997 |
| JP | 9-155587 A | 6/1997 |
| JP | 2000-015478 A | 1/2000 |
| JP | 2001-259885 A | 9/2001 |

OTHER PUBLICATIONS

"Manufacture of Braze and Solder Alloy Powders by Atomization", Fortuna D, Welding Journal, American Welding Society, vol. 83, No. 10, p. 40-44, Oct. 2004.
European Search Report dated Jun. 24, 2008.

* cited by examiner

*Primary Examiner*—George Wyszomierski
(74) *Attorney, Agent, or Firm*—Sughrue Mion, PLLC

(57) ABSTRACT

The present invention is a method to manufacture the SnZnNiCu solder powder through liquid quenching atomizing method, and an atomizing temperature is not less than 500° C., in particular, not less than 900° C. The raw material metal used as raw material of the solder powder comprises 3 to 12% by weight of Zn, 1.0 to 15% by weight of the sum of Cu and Ni, and Sn and inevitable impurities for the rest, to the total amount of raw material. Thereby, high joint strength is achieved and the SnZnNiCu solder powder which can improve joint reliability of solder joint part is provided.

6 Claims, 4 Drawing Sheets

METHOD OF MANUFACTURING THE SNZNNICU SOLDER POWDER AND THE SNZNNICU SOLDER POWDER

BACKGROUND OF THE INVENTION

1. Field of the Invention

The present invention relates to a method of manufacturing the SnZnNiCu solder powder having excellent joint reliability and the SnZnNiCu solder powder.

2. Description of Related Art

Conventionally, Sn—Pb alloy has been used as solder alloy. In recent years, however, due to concern about human health and the environment, Pb-free solder alloy containing no Pb has been developed. As the Pb-free solder alloy, for example, Sn—Ag solder alloy, Sn—Ag—Cu solder alloy and the like have been proposed. However, since these solder alloys have high melting point, heating temperature needs to be high during soldering and, in some cases, exceeds an allowable range of heat resistance of electronic parts. In addition, since $Ag_3Sn$ phase in solder grows large, strength of solder itself deteriorates.

On the other hand, Sn—Zn solder alloy has a potential means to solve the above problem, since Zn has the function of lowering a melting point and can lower heating temperature during soldering. For example, in each patent literature as below, various Sn—Zn solder alloys have been proposed.

Japanese Unexamined Patent Publication No. H8-243782 discloses Sn—Zn solder alloy containing 3 to 12% by weight of Zn and, as additional component, not more than 3% by weight of at least one selected from the group of Sb, In, Au, Ag and Cu. This solder alloy is considered to improve wettability during soldering by containing the above additional component.

Japanese Unexamined Patent Publication No. H9-94687 discloses Sn—Zn solder alloy containing 7 to 10% by weight of Zn, 0.1 to 3.5% by weight of Ag and/or 0.1 to 3% by weight of Cu. Japanese Unexamined Patent Publication No. H9-94688 discloses Sn—Zn solder alloy containing 7 to 10% by weight of Zn, 0.01 to 1% by weight of Ni, and 0.1 to 3.5% by weight of Ag and/or 0.1 to 3% by weight of Cu. These solder alloys are considered to improve tensile strength by containing the above additional component.

Japanese Unexamined Patent Publication No. H9-155587 discloses Sn—Zn solder alloy containing 7 to 9% by weight of Zn and 0.1 to 0.5% by weight of Cu. This solder alloy is considered to improve mechanical strength by containing the above additional component.

Japanese Unexamined Patent Publication No. 2000-15478 discloses Sn—Zn solder alloy containing not more than 0.5% by weight of an additional component such as Cu, Al and Ni. This solder alloy is considered to inhibit change in mechanical characteristics by containing the above additional component.

Japanese Unexamined Patent Publication No. 2001-259885 discloses Sn—Zn solder alloy containing 92 to 96% by weight of Sn, 1 to 5% by weight of Zn, 1 to 3% by weight of Cu and 0.5 to 2% by weight of Sb. This solder alloy is considered to achieve high joint strength.

By the way, soldering on Cu base material with the use of Sn—Zn solder alloy usually causes the problem that a thick fragile layer of Cu—Zn intermetallic compound is formed in the vicinity of the interface between the Cu base material and the solder alloy. Moreover, in soldering on Cu base material with the use of solder alloy which has Cu and the like added to improve mechanical strength and wettability as mentioned in each of the above patent literatures, addition of Cu to the solder alloy has made the intermetallic compound layer in the vicinity of the interface thicker. When such a Cu—Zn intermetallic compound layer is formed, joint strength between Cu base material and solder alloy and joint reliability deteriorate. The intermetallic compound layer further grows over time even after soldering, and along with the growth, joint reliability between Cu base material and solder alloy further deteriorates.

SUMMARY OF THE INVENTION

Previously, the present inventors considered Sn—Zn solder alloy which can inhibit the production of an intermetallic compound after soldering and the growth of the intermetallic compound after soldering, found that the above problem can be solved by keeping the content of Cu and Ni in a specific range, and filed a patent application (refer to Japanese Unexamined Patent Publication No. 2005-238297).

After that, the present inventors considered a method of manufacturing SnZnNiCu solder alloy containing Cu and Ni and consequently found a new fact that use of liquid quenching atomizing method under given conditions makes it possible to obtain SnZnNiCu solder alloy which reduces deterioration of joint strength and can achieve high joint reliability.

The method of manufacturing the SnZnNiCu solder powder according to the present invention is a method of manufacturing the SnZnNiCu solder powder in accordance with liquid quenching atomizing method and is characterized by an atomizing temperature of not less than 500° C. The atomizing temperature is preferably not less than 900° C. The composition of raw material metal used as raw material of the solder powder in the manufacturing method of the present invention preferably comprises 3 to 12% by weight of Zn, 1.0 to 15% by weight of the sum of Cu and Ni, and Sn and inevitable impurities for the rest, to the total amount of raw material. The raw material metal may further contain 0.0081 to 0.2% by weight of Al to the total amount of raw material. In the manufacturing method of the present invention, the raw material metal may be melted and rapidly quenched, being squirted out of a nozzle by atomization gas. The atomization gas may have a pressure of 1 to 15 MPa. The solder powder obtained according to the manufacturing method of the present invention may have a mean particle size of 5 to 100 μm. Larger mean particle size than the above range makes miniaturization of solder structure difficult and smaller mean particle size than the above range may increase the rate of a flux amount necessary for solder joint.

The present invention also provides the SnZnNiCu solder powder manufactured according to the aforementioned method.

The solder powder of the present invention preferably comprises 3 to 12% by weight of Zn, 1.0 to 15% by weight of the sum of Cu and Ni, and Sn and inevitable impurities for the rest, and may further contain 0.0081 to 0.2% by weight of Al. The solder powder of the present invention may have a mean particle size of 5 to 100 μm. Larger mean particle size than the above range makes miniaturization of solder structure difficult and smaller mean particle size than the above range may increase the rate of a flux amount necessary for solder joint.

The solder powder of the present invention obtained by atomization at 500° C. or more through liquid quenching atomizing method has small particle size and miniaturized submicron structure as inside solder structure. Furthermore, soldering on Cu base material with the use of the solder powder of the present invention prevents a thick fragile layer of Cu—Zn intermetallic compound from being formed in the vicinity of the interface between Cu base material and solder alloy. Thereby, the present invention prevents deterioration of joint strength between base material and solder alloy and can improve joint reliability of solder joint part. In this description, the "solder powder" according to the present invention is sometimes referred to as "solder alloy".

DETAILED DESCRIPTION OF PREFERRED EMBODIMENTS

The method of manufacturing the SnZnNiCu solder powder of the present invention and the SnZnNiCu solder powder will be described in detail below. The manufacturing method of the present invention is to manufacture the SnZnNiCu solder powder through liquid quenching atomizing method at an atomizing temperature of not less than 500° C., preferably not less than 900° C.

Figure 1:
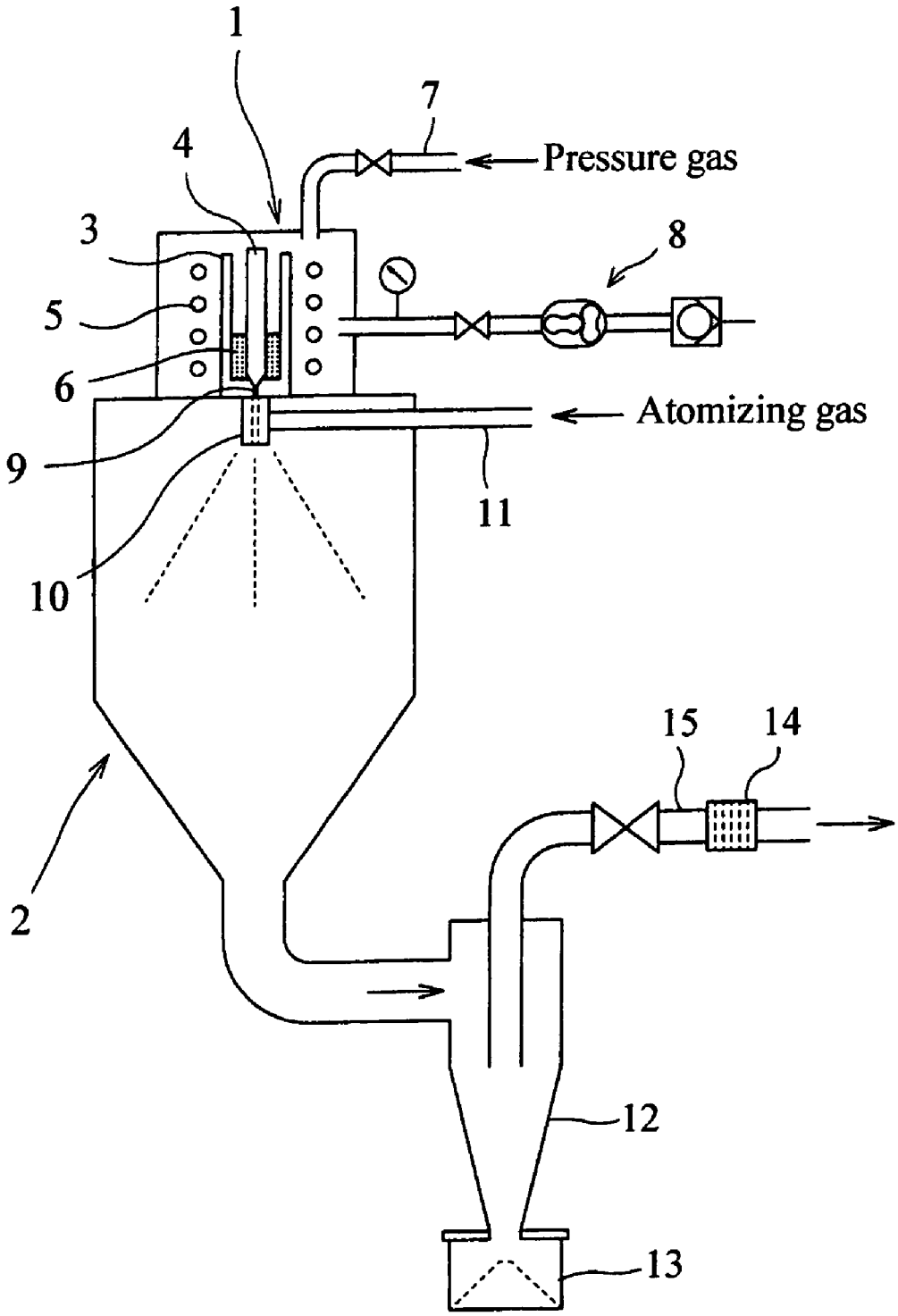
FIG. 1 is a schematic illustration showing an atomizing unit used in the method of the present invention.

For liquid quenching atomizing method, such a unit as shown in FIG. 1 can be used. The atomizing unit shown in FIG. 1 has a molten metal chamber 1 and an atomizing chamber 2 located below the molten metal chamber 1. The molten metal chamber 1 has a crucible 3 inside, a through-hole 9 is closed up by a stopper rod 4 at the bottom, and a molten metal alloy 6 is in the inside. Dielectric coils 5 are disposed around the crucible 3. In the molten metal chamber 1, a pressure gas inflow pathway 7 to supply pressure gas such as argon (Ar) gas and a vacuum system 8 such as a vacuum pump are provided. A thermocouple (not shown in the figure) to measure an atomizing temperature is provided in the through-hole 9.

The through-hole 9 at the bottom of the crucible 3 is communicated with a molten metal nozzle 10 provided in the upper part of the atomizing chamber 2. An atomizing gas supply pathway 11 to squirt the molten metal alloy 6 into the atomizing chamber 2 and rapidly quench is connected to the molten metal nozzle 10. Examples of atomizing gas include helium gas, nitrogen gas and argon gas. Atomizing gas may be supplied at a pressure of 1 to 15 MPa.

At the bottom of the atomizing chamber 2, a cyclone dust collector 12 is provided. A hopper 13 provided at the bottom of the cyclone dust collector 12 collects the solder powder, and waste gas goes through a filter 14 and is discharged from an exhaust pipe 15.

The liquid quenching atomizing method is to melt raw material metal and rapidly quench, being squirted out of a nozzle by atomization gas. For example, in the aforementioned atomizing unit, after solder raw material alloy is melted in the crucible 3 and turned into the molten metal alloy 6, with the stopper rod 4 lifted, the molten metal alloy 6 is supplied from the through-hole 9 to the molten metal nozzle 10, and atomizing gas is squirted from the molten metal nozzle 10 to the atomizing chamber 2 for atomization.

The atomizing temperature measured with the thermocouple may be not less than 500° C., preferably, not less than 900° C. Lower atomizing temperature than the above range makes particle size of the solder powder and inside solder structure large and possibly cannot improve solder joint strength. In the present invention, the atomizing temperature stands for a temperature of raw material metal (molten metal alloy 6) right before being atomized, and can be measured with the thermocouple in the unit shown in FIG. 1.

The raw material metal supplied to the crucible 3 contains Zn, Ni, Cu, and Sn and inevitable impurities for the rest. To the total amount of raw material, Zn content may be 3 to 12% by weight, preferably 8 to 10% by weight. To the total amount of raw material, the sum of Cu and Ni may be 1.0 to 15% by weight, preferably 1.5 to 10% by weight. The raw material metal may be in the form of alloy or each bare metal may be respectively weighed and supplied to the crucible 3 in a predetermined proportion. The ratio of Cu and Ni may be a weight ratio of Cu:Ni=1:9 to 9:1.

Thus, in the present invention, when atomization is carried out through liquid quenching atomizing method with the use of raw material metal containing Ni and Cu as well as Sn and Zn, during soldering, Cu and/or Ni in solder alloy to be obtained form an intermetallic compound with Zn in solder alloy and pick up part of Zn in solder alloy, thereby preventing Zn from moving to the vicinity of the interface with Cu base material during soldering and forming an intermetallic compound layer. Moreover, after soldering, there is an adequate amount of Cu and/or Ni contained to form an intermetallic compound in solder alloy by reacting with residual Zn in solder alloy and inhibit reaction with Cu base material in the vicinity of the interface. Thereby, not only during soldering but also after soldering, it is possible to prevent an intermetallic compound layer from being produced and growing in the vicinity of the interface between Cu base material and Zn.

When the total content of Cu and Ni as additional component exceeds the above range, a melting point of solder alloy significantly rises, wettability worsens and solder strength may deteriorate due to presence of inclusion. Melting point can be measured with a differential scanning calorimeter (DSC).

By keeping Zn content within the above range, it is possible to lower a melting point of solder alloy powder and maintain good wettability. Solder alloy can have a melting point of around 198 to 220° C. by keeping the composition within the above range.

The raw material metal (solder alloy) used as solder powder material may contain 0.0081 to 0.025% by weight, preferably 0.0081 to 0.02% by weight of Al to the total amount of raw material. Inclusion of Al prevents Zn oxide from being formed in solder alloy and can improve wettability between solder alloy and base material and increase solder alloy strength.

In addition, if necessary, the raw material metal (solder alloy) used as solder powder material can contain Bi, In, Sb, Mg, Ag and Au at the amount of not more than 5% by weight to the total amount of raw material, besides each of the above components. Thereby, a melting point of solder alloy can be further lowered during and after soldering.

Since the composition of the solder powder obtained in the manufacturing method of the present invention is almost identical to the composition of raw material metal used as solder powder material, the composition of the solder powder of the present invention may also be in the same range as the composition of the aforementioned raw material metal.

The mean particle size of the solder powder of the present invention is not especially limited, but preferably 5 to 100 μm. According to the manufacturing method of the present invention, the solder powder having a mean particle size in this range can be easily obtained.

The method of the present invention will be described in detail below with reference to examples.

EXAMPLES

<Manufacturing of the SnZnNiCu Solder Powder>

As raw material, alloys having the following composition were used. The figures are in terms of % by weight.

(1) Sn 91%-Zn 9%

(2) Sn 85.99%-Zn 8.6%-Ni 2.4%-Cu 3%-Al 0.01%

(3) Sn 82.05%-Zn 9.2%-Ni 3.6%-Cu 5.11%-Al 0.04%

Using each of the above raw material alloys, the solder powder was prepared with such an atomizing unit as shown in FIG. 1. Manufacturing conditions and mean particle size of the solder powder so obtained are as follows.

TABLE 1

| Sample | Atomizing temperature (° C.) | Material of crucible | Nozzle diameter (mm) | Pressure of atomizing gas (MPa) | Mean particle size of the solder powder (μm) |
|---|---|---|---|---|---|
| (1) | 500 | Carbon | 2 | 9.8 | 23.36 |
| (2) | 500 | Carbon | 2 | 9.8 | 16.92 |
| | 730 | Alumina | 2 | 9.8 | 12.73 |
| | 900 | Carbon | 1 | 9.8 | 8.69 |
| (3) | 500 | Carbon | 2 | 9.8 | 12.50 |
| | 730 | Carbon | 2 | 9.8 | 25.47 |
| | 900 | Carbon | 1 | 9.8 | 9.30 |

Figure 2:
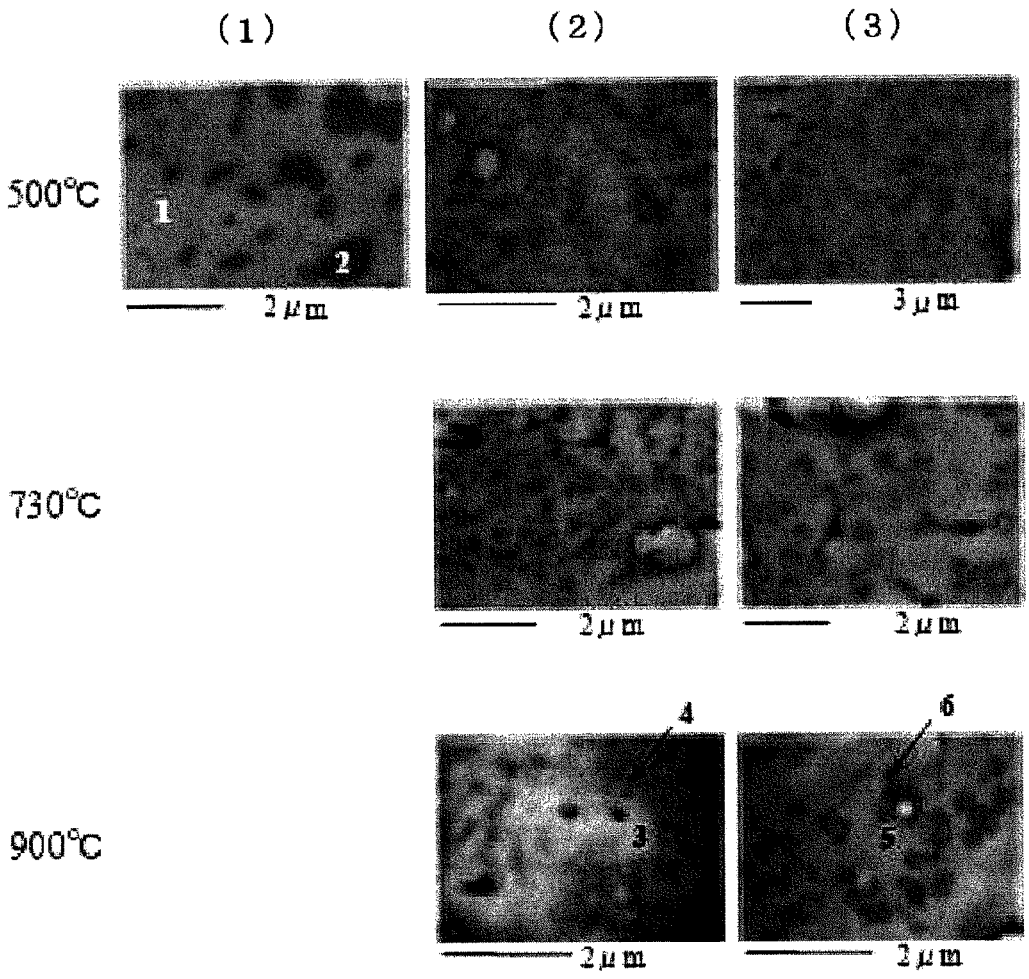
FIG. 2 is cross-sectional photographs showing the solder structure of atomized solder powders (1) to (3).
Figure 3:
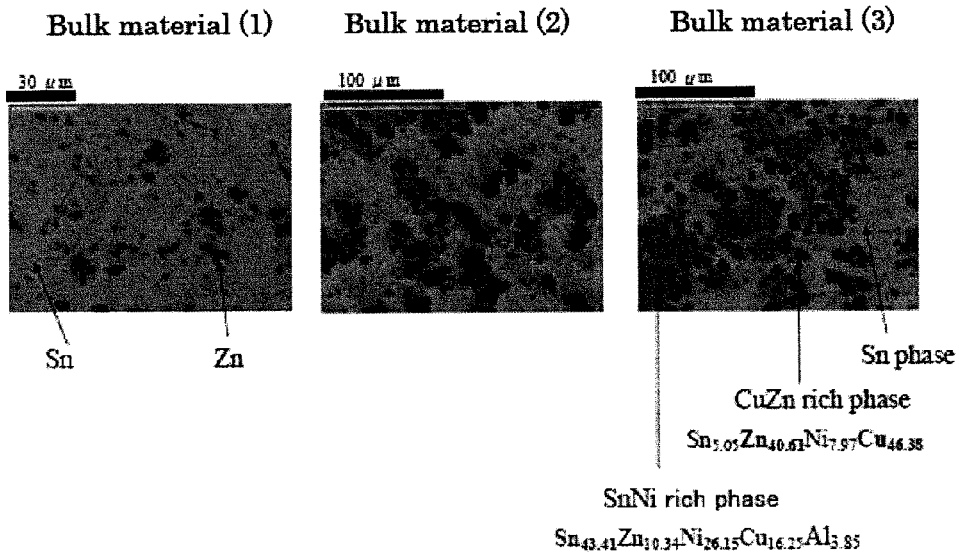
FIG. 3 is cross-sectional photographs showing the solder structure of bulk materials 1) to (3) which have the same composition and are used for comparison.

Particle structure of each solder powder so obtained was observed under a scanning electron microscope (SEM). The results are shown in FIG. 2. For comparison, bulk materials (1) to (3) (raw material alloy before atomization) having the same composition were observed in the same manner. The results are shown in FIG. 3. It is apparent that compared with the bulk material structure size 20 to 50 μm, atomized solder powder has miniaturized structure in the submicron order of not more than 1 μm. In particular, as an atomizing temperature is higher, the structure is more miniaturized. Consequently, atomized solder powders (1) to (3), especially (3), are projected to have high solder strength.

Furthermore, point analysis was made at the points marked as reference numerals 1 to 6 in each solder powder of FIG. 2 with an energy dispersive X-ray fluorescence analyzer (EDX). The results are shown in Table 2.

TABLE 2

| Measurement point | Sn | Zn | Ni | Cu | Al |
|---|---|---|---|---|---|
| 1 | 94.4 | 5.6 | | | |
| 2 | 10.3 | 89.7 | | | |
| 3 | 87.5 | 6.5 | 2.0 | 3.4 | 0.6 |
| 4 | 51.6 | 25.4 | 9.0 | 13.4 | 0.6 |
| 5 | 88.4 | 6.0 | 1.8 | 3.4 | 0.4 |
| 6 | 34.5 | 40.9 | 6.0 | 18.6 | 0.0 |

Unit: Atomic %

As apparent from Table 2, in solder structure (1) containing only Sn and Zn, Sn rich phase and Zn rich phase are separated, while in solder structures (2) and (3) having Ni and Cu added, there is no Zn single phase but there are CuZn rich phase and SnNi rich phase.

(Soldering Test)

Solder alloy of Samples (1) to (3) (all of which were obtained at an atomizing temperature of 500° C.) was soldered to Cu base material and the vicinity of the interface between Cu base material and solder alloy right after soldering was analyzed under a scanning electron microscope (SEM) with an energy dispersive X-ray fluorescence analyzer (EDX) to check the distribution of each component in the vicinity of the interface.

After these samples were heated in the atmosphere of 120° C. for 100 hours and for 500 hours, the distribution of each component in the vicinity of the interface between Cu base material and solder alloy was checked in the same manner as above. The distribution of each component is shown in the photographs of FIG. 4.

On the other hand, the bulk materials (1) to (3) having the same composition were soldered to Cu base material and the distribution of each component in the vicinity of the interface between Cu base material and solder alloy right after soldering and after heating in the atmosphere of 120° C. for 100 hours was checked in the same manner as above. The distribution of each component is shown in the photographs of FIG. 5.

Figure 4:
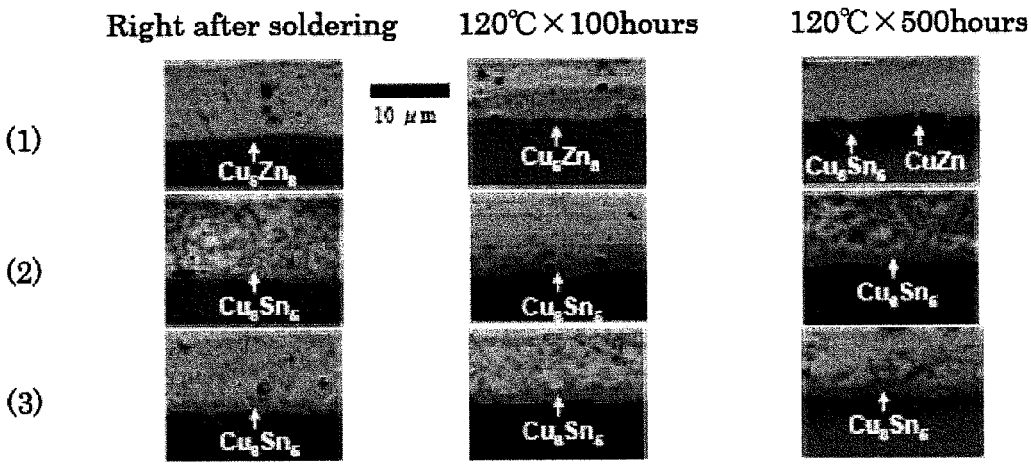
FIG. 4 is cross-sectional photographs showing the result of analysis in the vicinity of the interface with Cu base material when soldering Cu base material with the use of atomized solder powders (1) to (3).
Figure 5:
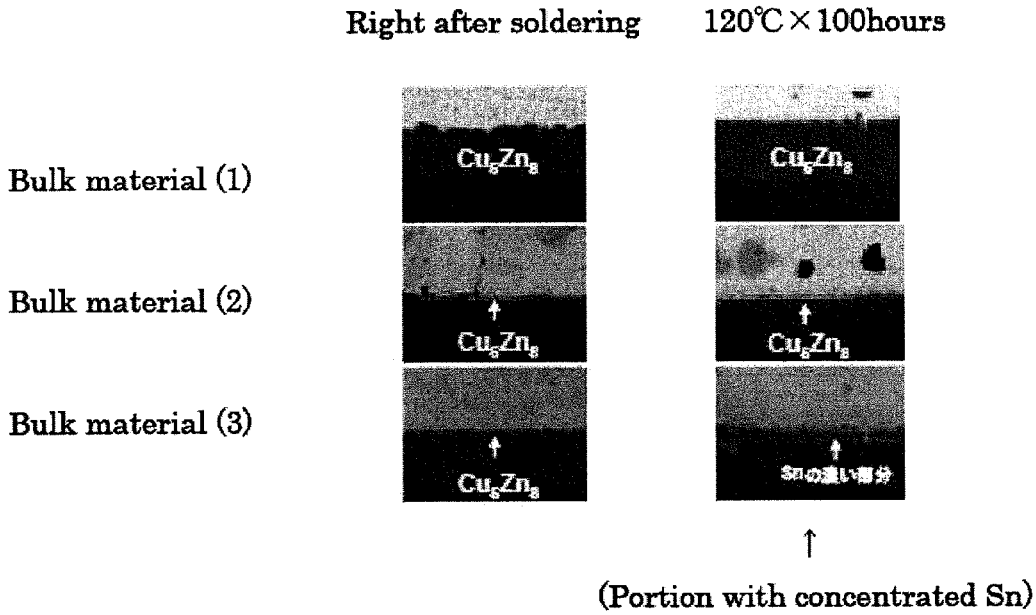
FIG. 5 is cross-sectional photographs showing the result of analysis in the vicinity of the interface with Cu base material when soldering Cu base material with the use of bulk materials (1) to (3) which have the same composition and are used for comparison.

As apparent from FIGS. 4 and 5, in the bulk materials (1) to (3), interface reaction phases with Cu base material were all CuZn compounds, while in atomized solder powders (2) and (3) containing Ni and Cu, CuSn compound phase was formed. The reason why CuSn compound phase, not CuZn compound, was formed in the interface like this is projected to be that Zn reacted with Ni and Cu and was taken in these elements, as shown in FIG. 2 and Table 2. The CuSn compound phase is similar to SnPb formed in the interface with Cu base material by conventionally widely used SnPb solder powder, making it possible to achieve high joint strength.

Also, there was a tendency for interface reaction phase to become thin through heating.

One embodiment of the present invention was illustrated above. However, it should be noted that the present invention is not limited to the above embodiment.

What is claimed is:

1. A method of manufacturing a SnZnNiCu solder powder comprising performing a liquid quenching atomizing method, wherein the composition of raw material metal used as raw material of the solder powder comprises 3 to 12% by weight Zn, 1.0 to 15% by weight of the sum of Cu and Ni, and Sn and inevitable impurities for the rest, to the total amount of raw material, and wherein an atomizing temperature is not less than 500° C.

2. The method of manufacturing the solder powder according to claim 1, wherein an atomizing temperature is not less than 900° C.

3. The method of manufacturing the SnZnNiCu solder powder according to claim 1, wherein the raw material metal further contains 0.0081 to 0.2% by weight of Al to the total amount of raw material.

4. The method of manufacturing the solder powder according to claim 1, wherein the raw material metal is melted and rapidly quenched, being squirted out of a nozzle by atomization gas.

5. The method of manufacturing the solder powder according to claim 4, wherein the atomization gas has a pressure of 1 to 15 MPa.

6. The method of manufacturing the solder powder according to claim 1, wherein the solder powder to be obtained has a mean particle size of 5 to 100 μm.

* * * * *